US006581493B1

(12) United States Patent
Gillane

(10) Patent No.: US 6,581,493 B1
(45) Date of Patent: Jun. 24, 2003

(54) PEDAL STABILIZING DEVICE

(76) Inventor: Maureen S. Gillane, 105 St. Andrews Ct., Slidell, LA (US) 70460

( * ) Notice: Subject to any disclaimer, the term of this patent is extended or adjusted under 35 U.S.C. 154(b) by 0 days.

(21) Appl. No.: 09/791,002

(22) Filed: Feb. 22, 2001

Related U.S. Application Data

(60) Provisional application No. 60/184,144, filed on Feb. 22, 2000, and provisional application No. 60/116,376, filed on Jan. 19, 1999.

(51) Int. Cl.[7] ..... G05G 1/16
(52) U.S. Cl. ..... 74/563; 403/24
(58) Field of Search ..... 74/563, 594.6; 403/24; 36/131; 474/146

(56) References Cited

U.S. PATENT DOCUMENTS

| | | | | | |
|---|---|---|---|---|---|
| 1,370,730 | A | * | 3/1921 | Carver | 74/563 |
| 1,562,993 | A | * | 11/1925 | Stanwood | 74/563 |
| 2,776,582 | A | * | 1/1957 | Blades | 74/563 |
| 3,823,058 | A | * | 7/1974 | Yamaguchi | 161/119 |
| 3,983,641 | A | * | 10/1976 | Wright | 36/72 B |
| 4,599,914 | A | * | 7/1986 | Dunn et al. | 74/563 |
| 4,846,461 | A | * | 7/1989 | Robards et al. | 272/72 |
| 4,856,211 | A | * | 8/1989 | Phillips | 36/131 |
| 4,944,340 | A | * | 7/1990 | Tortorich | 150/167 |
| 4,984,838 | A | * | 1/1991 | Kim | 296/75 |
| 5,018,564 | A | * | 5/1991 | Anglin et al. | 150/167 |
| 5,165,815 | A | * | 11/1992 | Allen | 403/24 |
| 5,170,574 | A | * | 12/1992 | Weisbrich | 36/131 |
| 5,215,348 | A | * | 6/1993 | Wen-Hwang | 296/97.23 |
| 5,771,607 | A | * | 6/1998 | Dean | 36/72 B |
| 5,795,009 | A | * | 8/1998 | Sack et al. | 296/78.1 |
| 2001/0023211 | A1 | * | 9/2001 | Bowman | 474/146 |
| 2002/0022820 | A1 | * | 2/2002 | Kline et al. | 604/389 |

FOREIGN PATENT DOCUMENTS

| | | | | |
|---|---|---|---|---|
| DE | 4319218 A | * | 1/1994 | 74/563 |
| WO | WO 00/60429 | * | 10/2000 | 74/563 X |

* cited by examiner

*Primary Examiner*—Vinh T. Luong
(74) *Attorney, Agent, or Firm*—Garvey, Smith, Nehrbass & Doody, LLC; Seth M. Nehrbass

(57) ABSTRACT

A fabric or other suitable, flexible material is cut, sewn and furnished with joinable hook and loop fastener portions to become a re-sizable pouch which itself envelopes the rearward portion of a foot operated pedal, preventing the undesirable movement of the pedal from the desired location of operation during use. A base portion of the pouch is fitted with joinable hook type fasteners on the posterior section of the base. The re-sizable pouch is then affixed with joinable hook type fasteners, attached to the posterior section of the base, to a secured portion of loop type material.

3 Claims, 6 Drawing Sheets

PEDAL STABILIZING DEVICE

CROSS-REFERENCE TO RELATED APPLICATIONS

Priority of U.S. Provisional Patent Application Serial No. 60/184,144, filed Feb. 22, 2000, incorporated herein by reference, is hereby claimed U.S. Provisional Patent Application Serial No. 60/116,376, filed Jan. 19, 1999, incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to the stabilization of an unsecured foot-operated pedal. More particularly, the present invention relates to securing the unsecured foot-operated pedal in such a manner as to prevent it from shifting from its desired location during the use of said pedal.

2. General Background of the Invention

Conventionally, foot pedals are used to control operational features and functions of many types of devices, including but not limited to musical keyboards, sewing machines, medical instruments, etc. For reasons of portability, flexibility of positioning, etc., these foot pedals may not permanently attach to the device or instrument that they control. Due to several factors including but not limited to lack of weight, mass, friction, etc., these foot pedals tend to shift from their optimal operating positions to awkward and sometimes inaccessible locations. This makes the operation of the pedal-controlled function of the particular instrument or device difficult to impossible depending on the degree of the pedal shift.

The "Pedal Stabilizing Device" was invented and designed to prevent foot pedals from this shifting and thus free the device operator to concentrate on the use of the instrument rather than chasing and finding its pedal.

Conventionally musicians use foot pedals for various musical effects. While playing their instruments and depressing their pedals, they find that the pedals slip from their original position. The pedal tends to shift from its original position when depressed. The musician, while playing, has to reach with his foot to return the pedal to its original position for ease of playing.

The following U.S. patents are incorporated herein by reference:

Not applicable

BRIEF SUMMARY OF THE INVENTION

The apparatus of the present invention solves the problems confronted in the art in a simple and straightforward manner. What is provided is a material specifically patterned to the design of the foot pedal device that limits its mobility during operation without impeding the use of such foot pedal.

The following invention has been proven to solve the problem mentioned in the Background of the Invention.

The following idea is for a device that will prevent an instrument's (keyboard etc.) floor pedal form shifting while a person is depressing the pedal with his foot. The original idea is for a keyboard sustain pedal but the application is not limited to a sustain pedal or even to a musical instrument. This device can be used to prevent many different objects depressed by the foot from slipping.

Device Design:

A pouch comprising of sturdy material with Velcro-like straps placed in strategic places. The straps wrap around the back and top of a pedal while the bottom of the pouch has Velcro-like hooks attached. The pedal is inserted on top of the pouch and the straps are adjusted to securely hold the pedal in place. The Velcro-like hooks on the bottom of the pouch, when placed on a material similar to Velcro-like loops or a sturdy loop-type carpet, holds the pouch/pedal in place during use.

Device Construction:

The pouch may be constructed by cutting out three pieces of sturdy material such as cotton duck canvas. Two pieces identical in shape make up the body of the device while one rectangular shape makes up the back strap. The strap is constructed by folding the rectangle lengthwise in half. One end of the fold and one side is tucked inside the folded material ½ inch and sewed together. One side of the folded material is left open. This side will be inserted in the back body of the device. The device is assembled by sewing the two identical pieces together along the front and sides with a ½ inch hem. The back is left open and after the inside and outside corners of the fabric are cut and trimmed the pouch is flipped from the back inside out. The edges of the back are then turned inside ½ inch and sewed together. The strap is added to the left side of the back during the process of sewing the back together and is placed on an angle tilting away from or to the left of the device. Velcro-like hooks and loops are then sewn to specific areas of the device to enable the device to wrap snugly around pedal.

This construction process represents one of several different manners in which this device may be constructed. Depending on the material used and the equipment used to construct this device, several different manners of construction may be employed.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
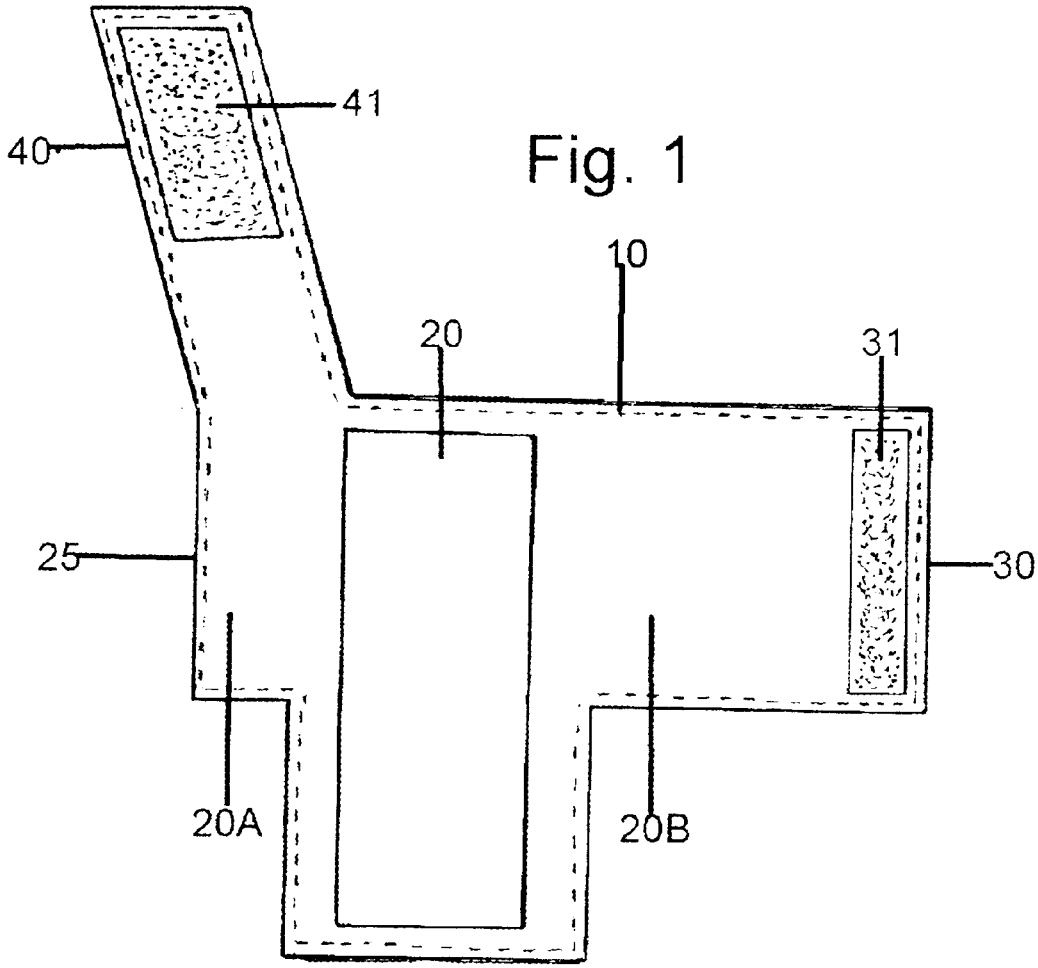
FIG. 1 is a top view of the preferred embodiment of the apparatus of the present invention.

The following design is a method of stabilizing an unsecured foot-operated pedal 50. This is accomplished by means of a pouch invention specifically designed for this purpose that preferably comprises sturdy fabric material (such as fabric, rubber, polyurethane, or other suitable material) which itself is secured to a stable foundation. Shaping the material in specific manner forms the pouch invention 10. Hereafter, the pouch invention may be referred to as the "device" 10 and the foot-operated pedal 50 may be referred to as the "pedal". The pedal 50 is placed on top the fabric base 20 having a first side 20A and a second side 20B toward the middle of the device 10. A side panel 25 of the material containing a strip of Velcro-like loops 26 (hereafter referred to as "loops") on the posterior edge is raised to embrace the side of the pedal. On the opposite side of the pedal, a larger panel 30 of the material containing a strip of Velcro-like hooks 31 (hereafter referred to as "hooks") on the anterior edge of the panel is raised to embrace the other side of the pedal 50, folding over the top rearward portion of the pedal and connecting the panel 30 containing hooks 31 to the panel 25 containing loops 26, thus forming the upper portion of the pouch 10. A strap 40 attached to one side of the device 10 and containing loops 41 on the anterior side of the strap wraps around the back of the rearward portion of the pedals 50 and secures to the other side of the device 10 by means of loops 41 on the anterior of the strap 40 attaching to hooks 42 on the posterior portion of the side panel 30. The posterior side of the pouch that resides underneath the pedal contains hooks 21 and 22 that are secured to a floor mat (not shown) consisting of loops. The stabilized base SB such as a floor mat is stabilized from shifting by the weight of a person standing on it or an object placed upon it. The floor mat may have dimensions of, for example, 18" by 24", though any appropriate size would work (such as at least 8" by 10", and preferably at least 12" by 24").

The floor mat is not needed if the device 10 will be used on flooring or other material having tight closed loops or similar structure.

The device 10 can be made of a 1000 denier weight canvas duck material.

The device 10 is preferably sized to snugly fit a pedal.

Range of Dimensions:

The dimensions of the rectangle formed by extending side panel (25) to side panel (30) can be as large as 40" wide by 10" long (to accommodate triple pedals) or as small as 4.5" wide by 1" long (to accommodate a small single pedal). The dimensions of the rectangle formed by location (20) can be as large as 15" wide (to accommodate a triple pedal) by 24" long and as small as 1" wide by 2" long (for a small single pedal). The dimensions of the rectangle formed at strap location (40) can be as large as 6" wide by 20" long (for a triple pedal) or as small as ⅛" wide by 2" long (for a small single pedal).

More specifically the dimensions of the rectangle formed by extending side panel (25) to side panel (30) can be as large as 25" wide by 7" long (to accommodate triple pedals) or as small as 6" wide by 2" long (to accommodate a small single pedal). The dimensions of the rectangle formed by location (20) can be as large as 9" wide (to accommodate a triple pedal) by 16" long and as small as 2½" wide by 5" long (to accommodate a small single pedal). The dimensions of the rectangle formed at strap location (40) can be as large as 3" wide by 13" long (for a triple pedal) or as small as 1" wide by 4" long (for a small single pedal).

More specifically the dimensions of the rectangle formed by extending side panel (25) to side panel (30) can be 10¾" wide by 4½". The dimensions of the rectangle formed by location (20) can be 4" wide by 9" long. The dimensions of the rectangle formed at strap location (40) can be 2" wide by 6" long.

Note: Side panel (25) and Strap (40) may be subdivided into multiple straps to accommodate irregularly shaped pedals.

A fabric or other suitable, flexible material is cut, sewn and furnished with joinable hook and loop fastener portions 26, 31, 41, 42 to become a re-sizable pouch which itself envelopes the rearward portion of a foot operated pedal, preventing the undesirable movement of the pedal from the desired location of operation during use. A base portion 20 of the pouch is fitted with joinable hook type fasteners 21, 22, on the posterior section of the base 20. The re-sizable pouch is then affixed with joinable hook type fasteners 21, 22, attached to the posterior section of the base 20, to a secured portion of loop type material.

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

Figure 2:
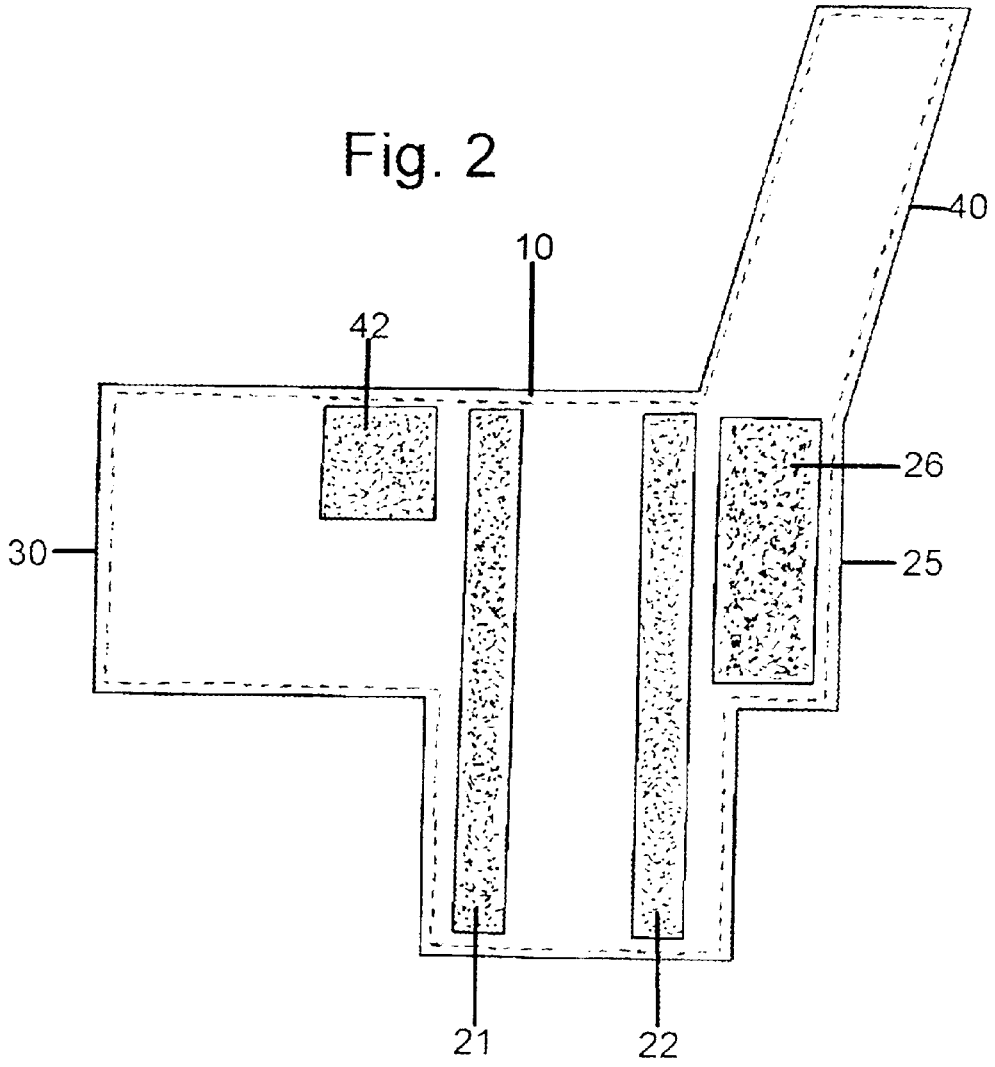
FIG. 2 is a bottom view of the preferred embodiment of the apparatus of the present invention.
Figure 3:
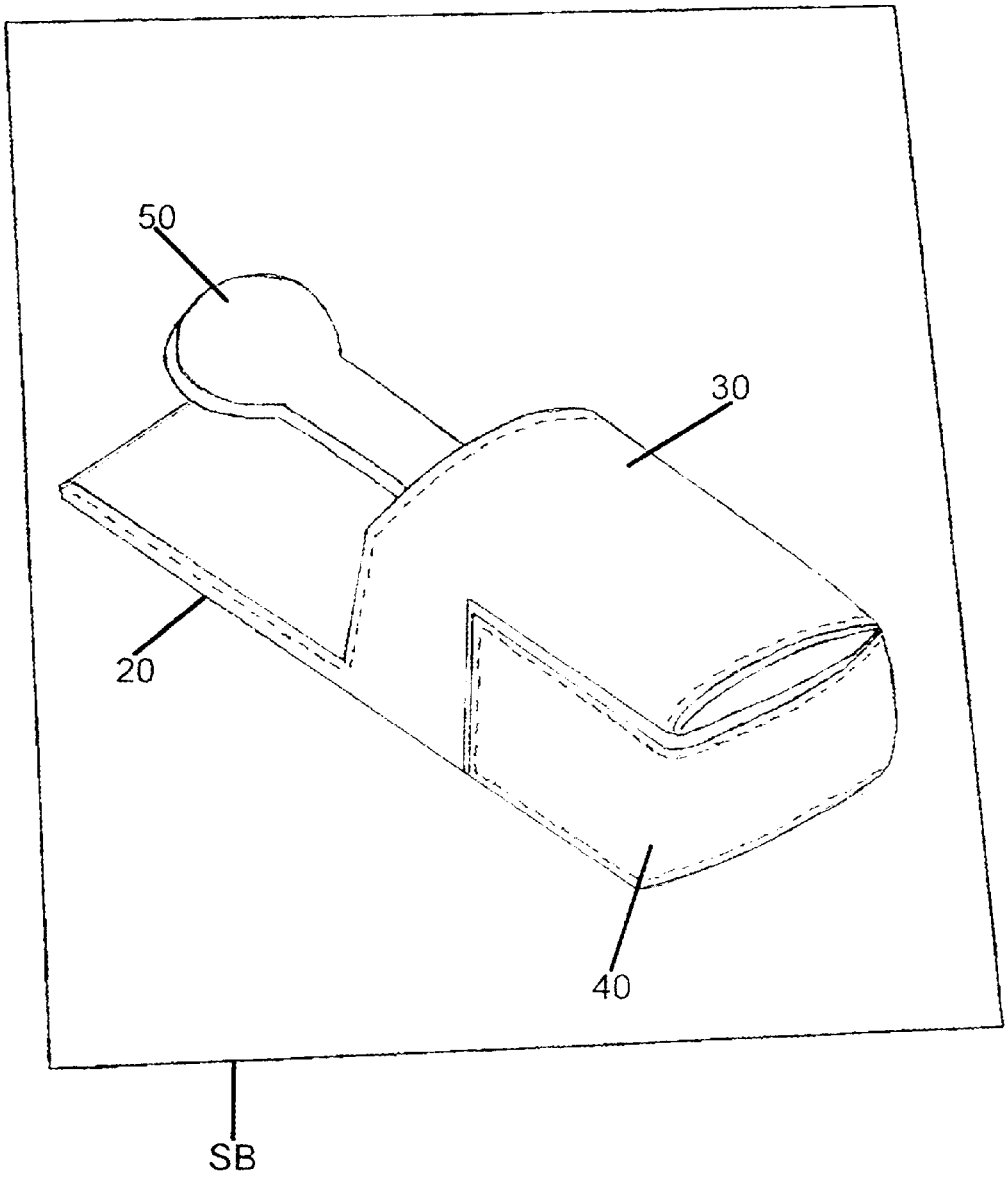
FIG. 3 is a right side view of the preferred embodiment of the apparatus of the present invention.
Figure 4:
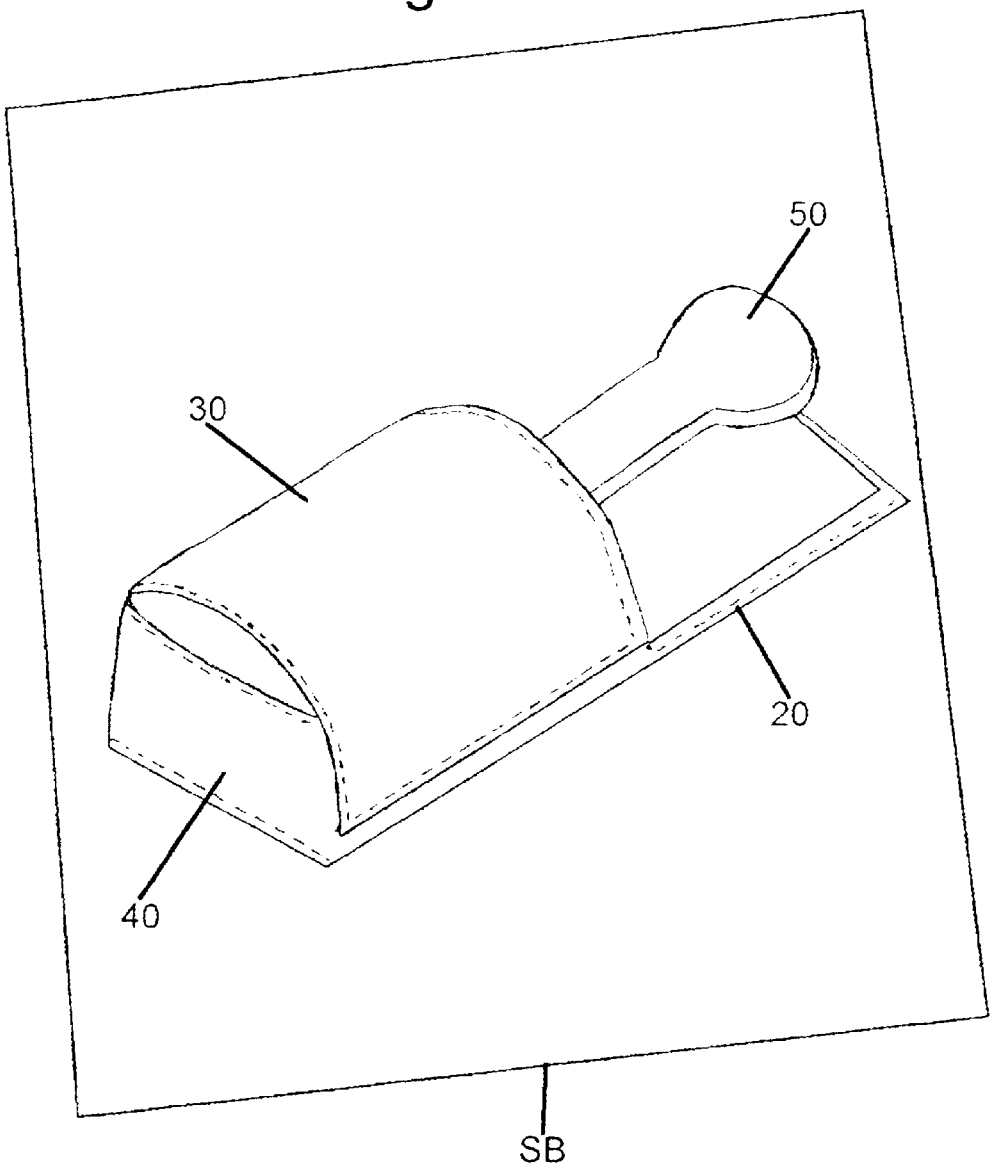
FIG. 4 is a left view of an preferred embodiment of the apparatus of the present invention.
Figure 5:
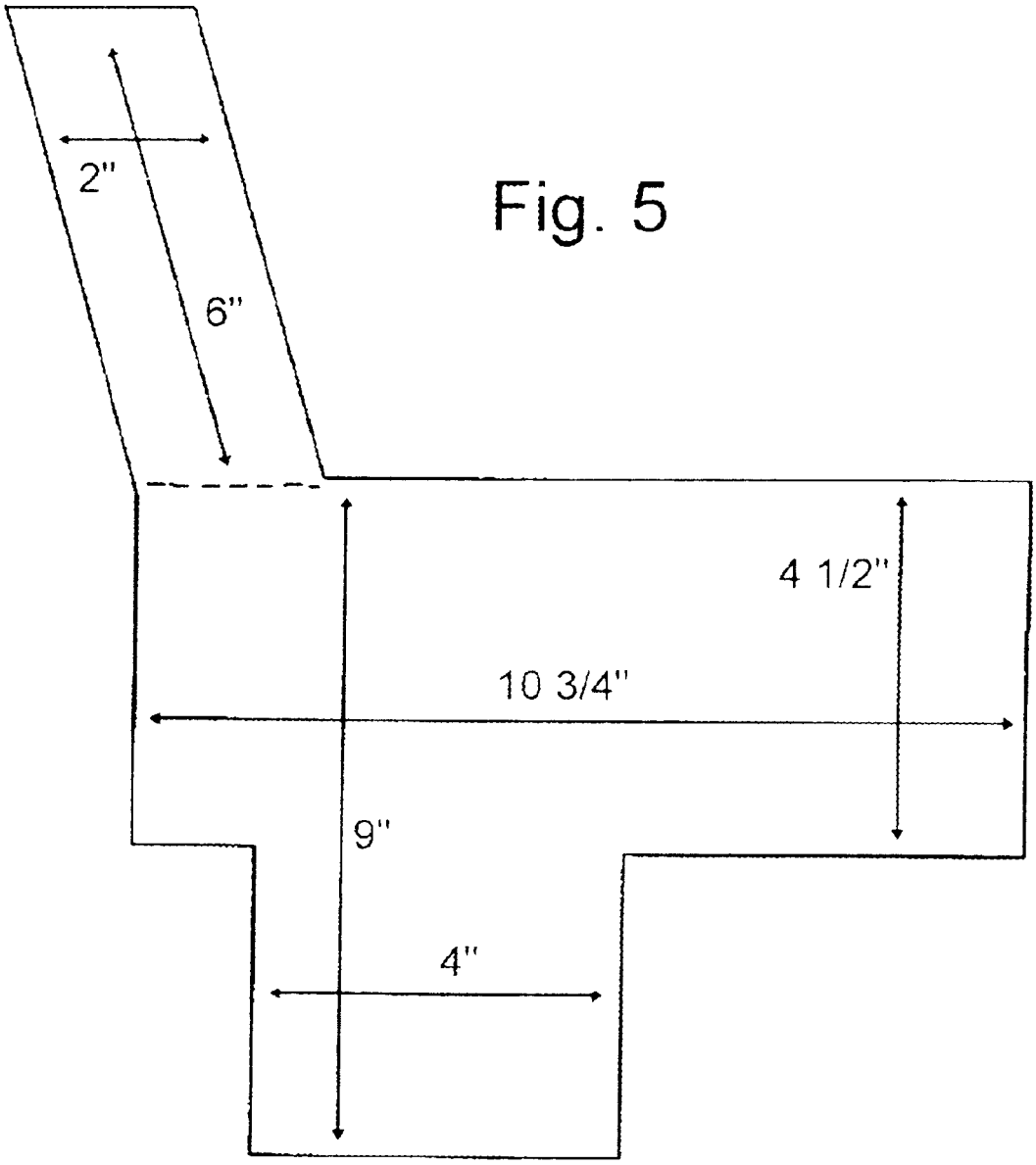
FIG. 5 shows exemplary dimensions for the preferred embodiment of the apparatus of the present invention
Figure 6:
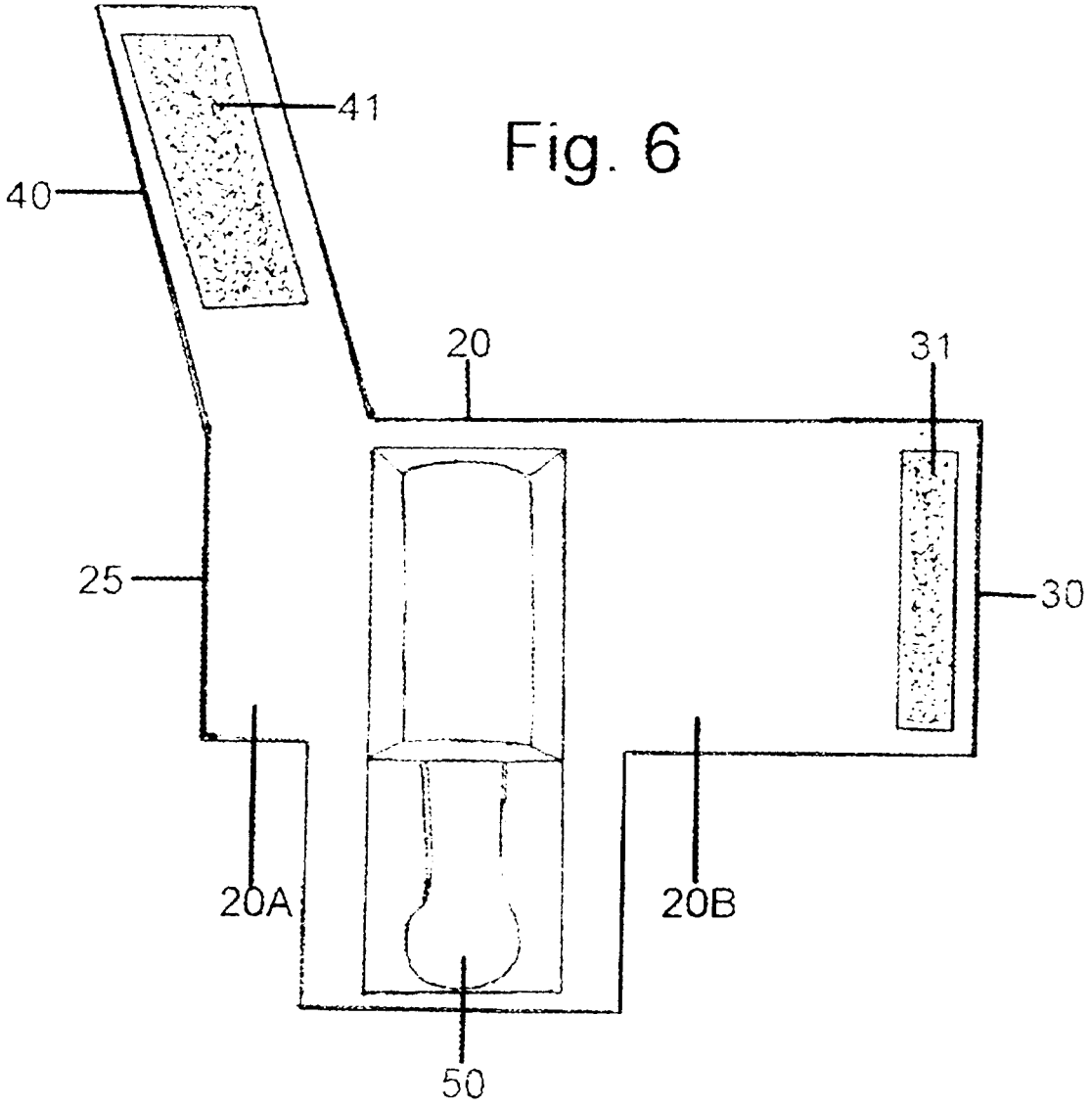
FIG. 6 shows how to make the preferred embodiment of the apparatus of the present invention

What is claimed is:

1. Apparatus (10) forming a resizable pouch that envelops a rearward portion of a foot-operated pedal (50) for preventing undesirable movement of the foot-operated pedal (50) during use while not impeding the use thereof having an integral arrangement comprising:

a fabric base (20) upon which the foot-operated pedal (50) rests, the base (20) having a first side (20A) and a second side (20B); a first side panel (25) extending from the first side (20A) of the base (20) to form a flap (25) which is lifted up to embrace a side of the foot-operated pedal (50), the flap (25) having upon its posterior portion a section of joinable loop fasteners (26, FIG. 2), the first side panel (25) having a rearward portion, a strap (40, FIG. 2) attached to the rearward portion of the first side panel (25), which passes behind a rearward portion of the foot-operated pedal (50, FIGS. 3 and 4), and which attaches by means of first joinable hook fasteners (42, FIG. 2) to a second side panel (30) extending from the second side (20B) of the base (20), the second side panel (30) extending over the foot-operated pedal (50) to form the strap (40, FIGS. 3 and 4) and affixes by means of second joinable hook fasteners (31) to the section of joinable loop fasteners (26) present on the posterior portion of the first side panel (25); another two strips of joinable hook fasteners (21 and 22) attached underneath the base (20) of the apparatus which secure the apparatus (10) to a stabilized base (SB, FIGS. 3 and 4) that has a loop material to which the two strips of joinable hook fasteners (21 and 22) may grab.

2. The apparatus as claimed in claim 1, wherein the stabilized base (SB) is a tight looped carpet.

3. The apparatus as claimed in claim 1, wherein the stabilized base (SB) is a tight looped mat.

* * * * *